US010286330B2

(12) United States Patent
Yatsko

(10) Patent No.: US 10,286,330 B2
(45) Date of Patent: May 14, 2019

(54) APPARATUS AND METHOD FOR ARIAL GAME PLAYING

(71) Applicant: Joseph S. Yatsko, Medina, OH (US)

(72) Inventor: Joseph S. Yatsko, Medina, OH (US)

( * ) Notice: Subject to any disclaimer, the term of this patent is extended or adjusted under 35 U.S.C. 154(b) by 0 days.

(21) Appl. No.: 15/055,759

(22) Filed: Feb. 29, 2016

(65) Prior Publication Data

US 2016/0250535 A1 Sep. 1, 2016

Related U.S. Application Data

(60) Provisional application No. 62/121,787, filed on Feb. 27, 2015.

(51) Int. Cl.
*A63H 30/04* (2006.01)
*A63H 27/00* (2006.01)

(52) U.S. Cl.
CPC ..... *A63H 30/04* (2013.01); *A63H 27/12* (2013.01)

(58) Field of Classification Search
CPC ..... G06K 9/00; G06F 19/00
USPC ..... 273/317.1; 382/103; 701/23
See application file for complete search history.

(56) References Cited

U.S. PATENT DOCUMENTS 8,214,098 B2 * 7/2012 Murray ..... A63H 30/04 382/103
9,580,173 B1 * 2/2017 Burgess ..... B64C 39/024
2011/0299732 A1 * 12/2011 Jonchery ..... A63H 27/12 382/103
2014/0117147 A1 * 5/2014 Hanna ..... B64C 39/024 244/2
2017/0244937 A1 * 8/2017 Meier ..... H04N 7/188

OTHER PUBLICATIONS http://www.prnewswire.com/news-releases/introducing-zyro-droneball-300035114.html.*
https://www.youtube.com/watch?v=3CR5y8qZf0Y.*
https://www.youtube.com/watch?v=IAV_sjwY8MI.*

* cited by examiner

*Primary Examiner* — Alvin Hunter
*Assistant Examiner* — Christopher Glenn
(74) *Attorney, Agent, or Firm* — Dwight A. Stauffer

(57) ABSTRACT

Methods, devices and attachments for game-playing (sports) that involves manipulating objects in X, Y and Z planes (3-D space) using remote controlled aerial craft such as a drone that has hovering capability. Particularly characterized by the use of at least one human player controlled craft plus a passive aerial playing object like a game ball that players can only indirectly control by physically manipulating it with the player craft.

12 Claims, 5 Drawing Sheets

APPARATUS AND METHOD FOR ARIAL GAME PLAYING

CROSS-REFERENCE TO RELATED APPLICATIONS

This application claims the benefit of US Provisional Patent Application No. 62/121,787, filed Feb. 27, 2015, said application hereby incorporated in its entirety by reference herein.

TECHNICAL FIELD OF THE INVENTION

The present invention relates to method and apparatus for sports played above the ground using remote controlled aerial craft.

BACKGROUND OF THE INVENTION

Small propeller driven aerial craft, particularly model airplanes, that are remotely controlled by a person on the ground have long been used in competitive sports that are focused on traditional airplane activities such as racing, acrobatics and simulated "combat" (e.g., cutting a trailing ribbon off the opponent's plane.) Both wire controlled and radio controlled planes can be utilized. Model helicopter's have been competitively flown in similar ways to model airplanes.

Small aerial craft typically called "drones" have recently been added to the amateur radio controlled aircraft world. These amateur recreational or sporting drones typically have multiple helicopter-like rotors that can be controlled to hover and to rapidly change among a variety of maneuvers such as spins, flips, turns and movement in any horizontal or vertical direction at varying speeds. To date these enhanced aerial capabilities have been utilized to expand aerial competition to shows of skill such as acrobatics and running an obstacle course. The latter is made possible by addition of a video cam onboard.

It is an object of the present invention to greatly expand aerial competition into a new form of competitive sports, or game playing.

BRIEF SUMMARY OF THE INVENTION

According to the invention aerial craft (e.g., drones) are adapted and used to play 3-D (three dimensional) aerial versions of sports (games) in which at least one player's remote controlled drone indirectly manipulates a passive playing object with intent to achieve a particular objective according to rules of the game. Indirect manipulation means that a player causes the playing object to move in reaction to the player's drone movement/actions.

At least one playing object is made to float (hover) in the 3-D game field and is otherwise passive, i.e., its movement is not directly controlled by any player. Floating generally means counteracting the effect of gravity, preferably exactly canceling it out (neutral buoyancy). Other than floating, the playing object is preferably configured to react in a game appropriate way in response to manipulation by a player drone.

In preferred embodiments, the passive playing object will not cause a change in its own motion independently of reacting to player manipulation according to game rules.

Alternatively, the playing object may be programmed to automatically react to movement of one or more player's drone movements to make contact more difficult, simulating avoidance maneuvers.

The passive playing object may comprise a drone enclosed in a shell.

The passive playing object may have automated and/or non-player remote controls that enable adjustments in its behavior while floating and/or while reacting to player drone actions/manipulations.

Alternative embodiments may use a non powered lighter-than-air device as the playing object, e.g., a floating ball or balloon attached to a string (e.g., helium filled).

Alternative embodiments may use non-powered objects that do not float (i.e., heavier than air), e.g., a simple ball thrown into the air.

The passive playing object may be in a game appropriate cage/shell that forms a surface to be struck by the player drones. For example, a spherical "ball" shape, a disc shaped "puck", etc.

A human player remotely controls (e.g., radio control) movement of a player drone in the game field 3-D space, and the player drone has a game-appropriate means for indirectly causing reactive movement of the playing object.

E.G., appended implements such as a racket, bat, golf club, scoop, glove, hand, foot, etc.

E.G., a whole body, or incorporated implement such as a cylindrical cage around drone to simulate a person's torso, a hemispheric cage as a soccer player's head, and other appropriately shaped drone cage/bodies.

Can be played alone with one player drone and one playing object, or as two opposed players or as team sport with two or more players in opposed teams.

3-D hockey example:

Passive object drone acts as a puck.

Player drones have hockey stick-like implements to pass, shoot, steal and block the puck drone.

Goal could be a tethered floating cage, a pole-mounted goal, etc.

Soccer example:

Could be played without appended devices such that the player drone body or protective shell could be used to pass, shoot, steal and block a ball shaped object drone.

Football example:

Could be played with a simple foam or plastic shell football shaped playing object.

Use of specialized attachments for various player position specific tasks.

May be enhanced with the use of magnet-like apparatus.

Additional variations can include active drone appendages, e.g., rackets that swing, feet that kick, hands that grasp, catch or pass; etc.

Other objects, features and advantages of the invention will become apparent in light of the following description thereof.

BRIEF DESCRIPTION OF THE DRAWINGS

Reference will be made in detail to preferred embodiments of the invention, examples of which are illustrated in the accompanying drawing figures. The figures are intended to be illustrative, not limiting. Although the invention is generally described in the context of these preferred embodiments, it should be understood that it is not intended to limit the spirit and scope of the invention to these particular embodiments.

Certain elements in selected ones of the drawings may be illustrated not-to-scale, for illustrative clarity. The cross-sectional views, if any, presented herein may be in the form of "slices", or "near-sighted" cross-sectional views, omitting certain background lines which would otherwise be visible in a true cross-sectional view, for illustrative clarity.

Elements of the figures can be numbered such that similar (including identical) elements may be referred to with similar numbers in a single drawing. For example, each of a plurality of elements collectively referred to as 199 may be referred to individually as 199*a*, 199*b*, 199*c*, etc. Or, related but modified elements may have the same number but are distinguished by primes. For example, 109, 109', and 109" are three different versions of an element 109 which are similar or related in some way but are separately referenced for the purpose of describing modifications to the parent element (109). Such relationships, if any, between similar elements in the same or different figures will become apparent throughout the specification, including, if applicable, in the claims and abstract.

Figure 1:
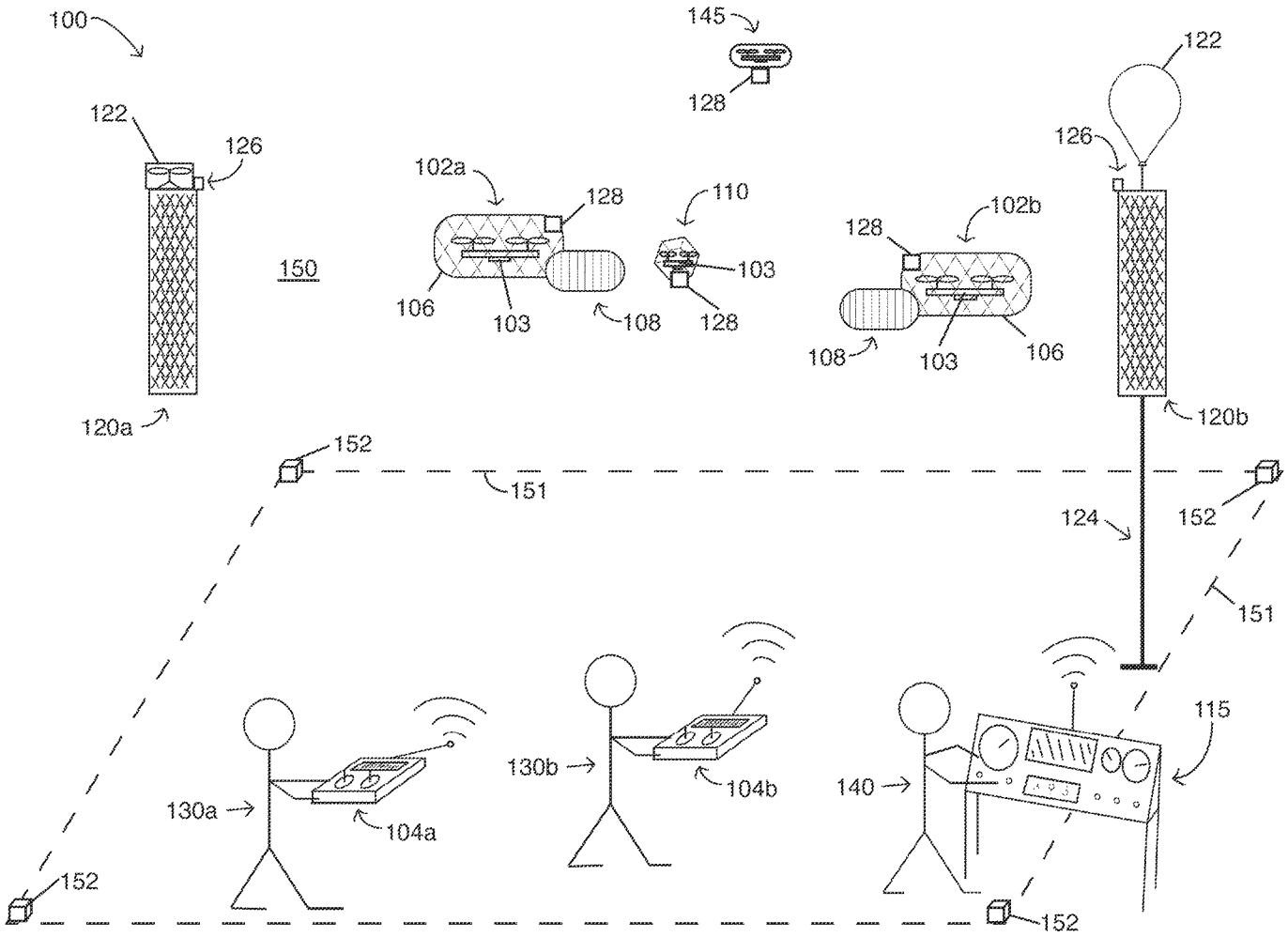

The structure, operation, and advantages of the present preferred embodiment of the invention will become further apparent upon consideration of the following description taken in conjunction with the accompanying drawings, wherein:

FIG. 1 is a schematic side view of a soccer embodiment of an aerial game (method and apparatus) according to the invention.

Figure 2:
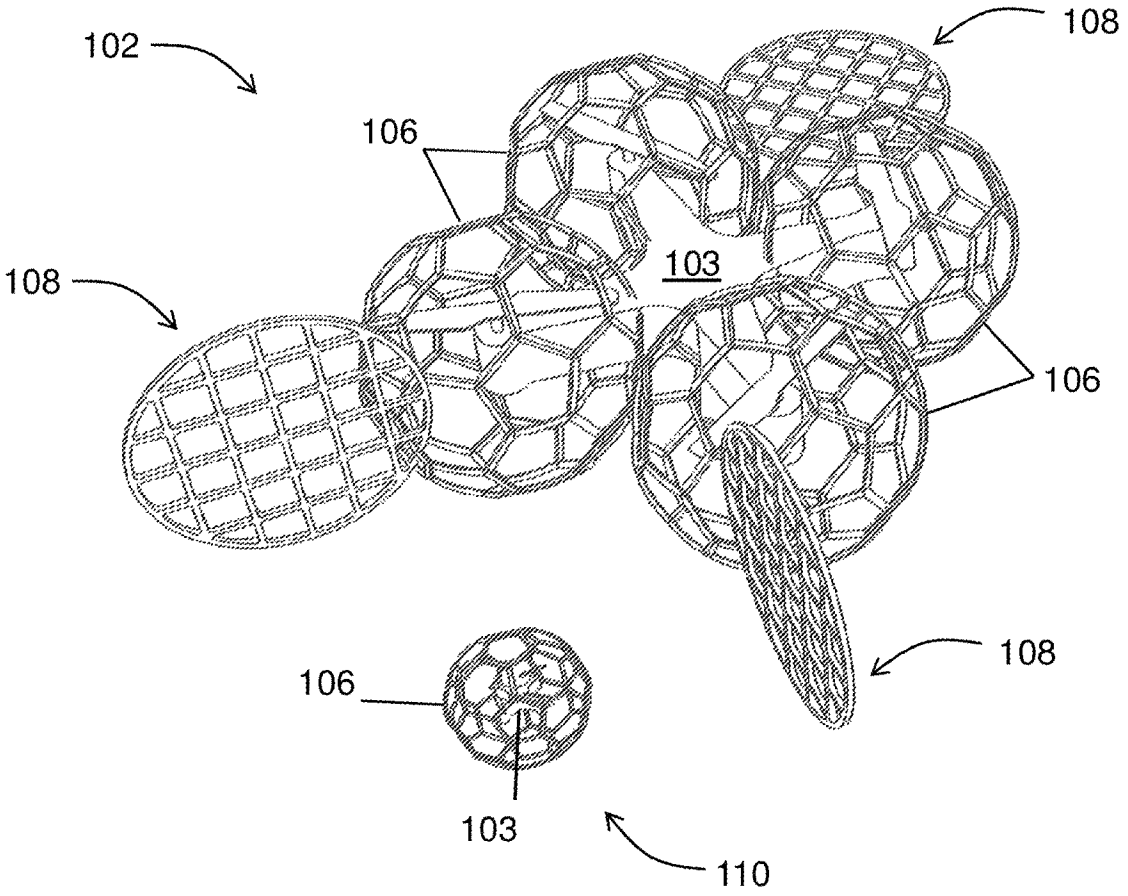

FIG. 2 is a perspective view of a soccer embodiment of a player controlled aerial craft and a passive aerial playing object according to the invention.

Figure 3B:
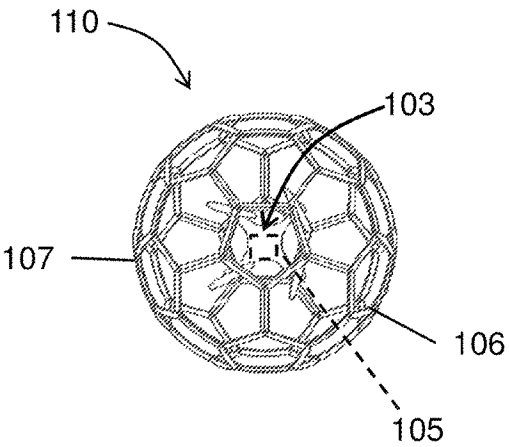
Figure 3A:
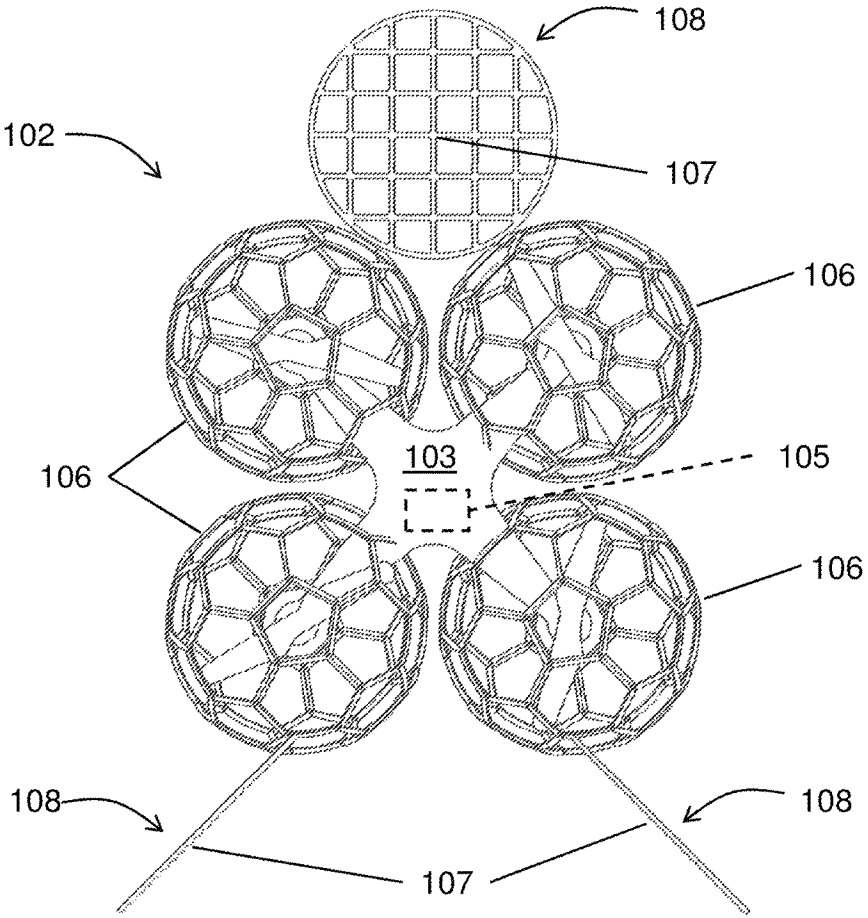

FIGS. 3A and 3B are top views of the FIG. 2 player controlled aerial craft and passive aerial playing object, respectively, according to the invention.

Figure 4A:
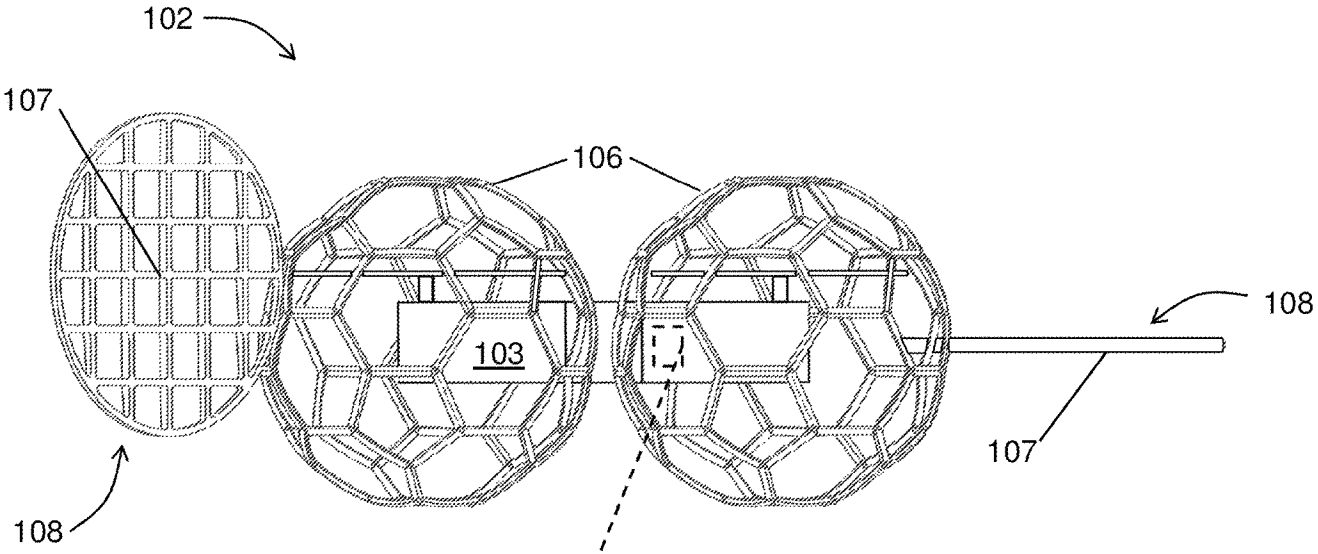
Figure 4B:
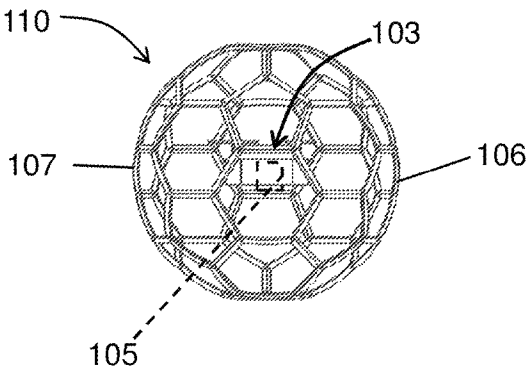

FIGS. 4A and 4B are side elevation views of the FIG. 2 player controlled aerial craft and passive aerial playing object, respectively, according to the invention.

Figure 5A:
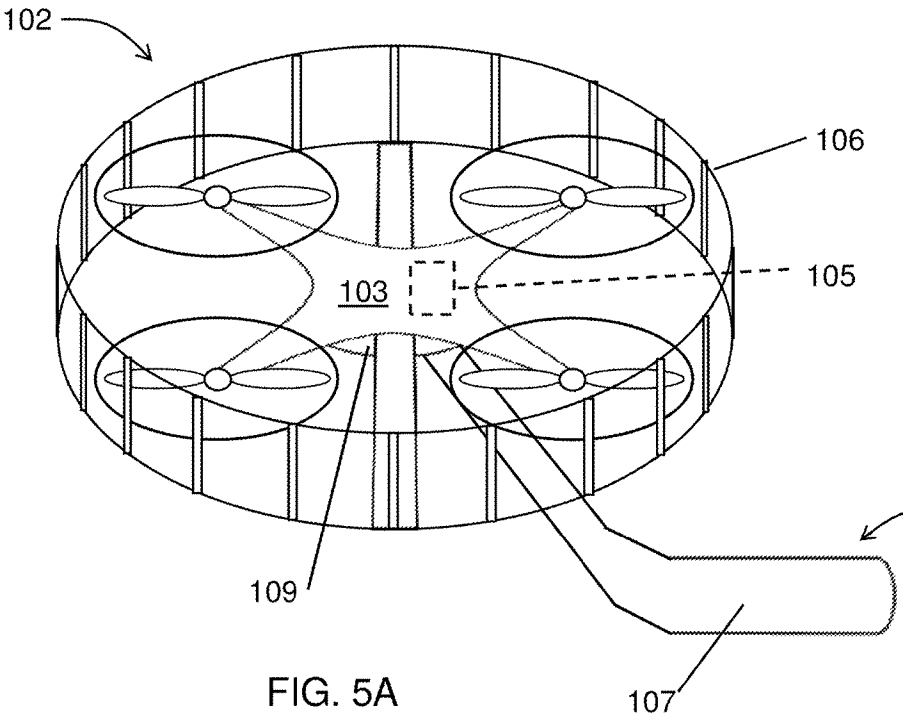
Figure 5B:
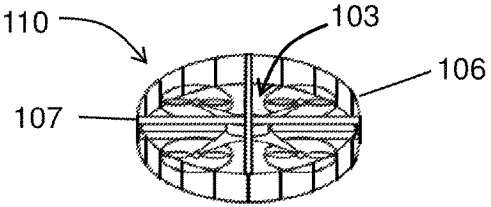

FIGS. 5A and 5B are perspective schematic views of a hockey embodiment of the player controlled aerial craft and the passive aerial playing object, respectively, according to the invention.

DETAILED DESCRIPTION OF THE INVENTION

The following table is a glossary of terms and definitions, particularly listing drawing reference numbers or symbols and associated names of elements, features and aspects of the invention(s) disclosed herein.

| REF. | TERMS AND DEFINITIONS |
|---|---|
| 100 | Aerial game apparatus |
| 102 | player-controlled aerial craft (active device) |
| 103 | copter type of flying device, commonly known as a drone (non-military), and having at least hovering capability, is elevating and motive means for the player craft 102 and the playing object 110 |
| 104 | a player's remote control |
| 105 | on-board microprocessor/controller integrated with the copter 103 to implement the detailed actions of functions commanded by the remote control 104. For example, to implement a command to accelerate "forward" as indicated by a forward tilt of a joystick on the remote, a quad copter's processor must consult its sensors to determine the direction that is "forward" and then coordinate a series of different blade rotations for each of the four copter motors. |
| 106 | cage or shell around the drone/copter device |
| 107 | repellant or attractive device, generically referenced as a "magnet" |
| 108 | manipulation attachment, e.g., paddle, racket, hockey stick, etc. |
| 109 | functional control for attachment 108 (shown in FIG. 5A) |
| 110 | playing object, a passive (not player controlled) aerial craft/device |
| 115 | game controller utilized by a non-player 140 |
| 120 | goal, net, or similar stationary object portion of a game playing field 150 |
| 122 | hovering or floating passive device used to hold stationary field object 120 aloft |
| 124 | ground support post or tethering cable for holding field object 120 in position |
| 126 | goal detection device/sensor |
| 128 | camera, video cam which transmits live/real time images back to controller 104, 115 |
| 130 | player of the game, controls one aerial craft 102 |
| 140 | non-player, e.g., technician, referee, overall game manager/controller/enabler/supervisor |
| 145 | auxiliary passive device, utilized by the non-player 140 to facilitate game playing |
| 150 | game playing "field" above ground level |

The invention(s) will now be described with reference to the drawings using the reference numbers and symbols listed in the above table.

Aerial Game Playing In General

In general, (referring to FIG. 1) the present disclosure relates to aerial craft (e.g., copter-like "drones") 103 that are adapted to be used in playing 3-D (three dimensional) aerial versions of sports (games) 100 in which at least one player's 130 remote controlled drone 102 manipulates a passive (not player-controlled) playing object 110 with intent to achieve a particular objective according to rules of the game/sport. The player 130 indirectly manipulates the playing object 110 by causing it to move in reaction to movement/actions of the drone/craft 102 that is remotely controlled 104 by the player 130. In effect, multiplayer sports (e.g., tennis, soccer) that are normally played by human players moving around a playing area/field laid out on the ground (e.g., tennis court, soccer pitch), are indirectly played above the ground using aerial craft as analogous substitutes for both the player(s) and the playing object(s) (e.g., tennis ball, soccer ball).

The aerial craft (e.g., 102, 110) may comprise a helicopter or a multi-blade/rotor "copter" type of "drone" 103, which includes integral controllers 105, sensors 124, actuators/motors and the like as needed to achieve desired functions including, at a minimum, hovering. The player controlled craft 102 (active device) capabilities also should include turning, starting and stopping movement in any 3D direction, at controllably variable speed and acceleration. At least the player-controlled craft 102 are "remote controlled" by a controller 104 utilized by the player 130: e.g., hand-held remote control boxes (typically radio frequency but may be other transmission types like infrared/IR).

Various features of the playing field 150 are implemented as needed by analogous objects and/or limits that are suitably raised above ground. For example, FIG. 1 schematically illustrates an aerial soccer game (method and apparatus) embodiment 100 according to the invention. A field 150 has at least one goal cage 120 at each end of the field. An on-ground player 130 (two opposed players 130*a*, 130*b* shown) uses a remote control 104 to maneuver his player-drone 102 around the aboveground 3D field 150 (first and second players 130*a*, 130*b* each use a controller 104*a*, 104*b* that is specific to the player's drone 102*a*, 102*b* respectively). The player drones 102 pursue and attempt to manipulate the playing object 110 (a simulated soccer ball) by striking it with an attachment 108 (a simulated foot) and/or a drone-surrounding cage 106 (simulating a player's body). An optional non-player 140 may utilize a game controller 115 for actions that may include, for example, providing auxiliary/external control of the playing object(s) 110, monitoring or refereeing via an auxiliary passive device 145 (e.g., having a video cam 128), goal determination via a goal detection device 126, and maintaining the location of a goal 120*a* that is held aloft by a hovering passive device 122. Alternatively, the goal (e.g., 120*b*) may be held in position by ground supports or tethering cables 124. Additional features and functions are further detailed in the description hereinbelow.

Playing Object(s) to be Manipulated

A playing object 110 is a passive (not player-controlled) aerial craft to be used as a floating "ball", "puck" or similar game (or sport) object. The motive part 103 of this aerial craft may be a helicopter or a multi-bladed copter type of drone 103, for example, and includes any integrated processors 105, sensors, actuators and the like needed to achieve desired functions such as hovering in place. For example, there may be any combination of onboard or remote microcontroller/computer/processor 105, and onboard sensors such as an accelerometer, multi axis gyro, barometric pressure, temperature, digital compass, magnetometer, telemetry, GPS, altimeter and video camera 128, which can provide feedback in an endless loop beginning upon powering on the device so as to attain a self-regulating/correcting predetermined height, hover and hold a relatively fixed x, y, z position until acted on by a player's aerial craft 102. The floating height (z) value and interaction response value(s) (sensitivity) may be set by a potentiometer or similar means so as to allow user changeability/designation or be internally (in software/firmware) or externally (hardware) factory set at predetermined value(s). Remote control 115 (radio/IR) of the passive aerial craft is generally not necessary for x,y control of the passive device, however a non-player technician 140 or automated device such as a computer could use remote control 115 to achieve predetermined behavior that may not be otherwise attainable.

Onboard GPS sensors could be adapted to respond to a local positioning system (LPS) that substitutes local beacons for the GPS satellites to create a closed, local positioning system using three (or more) beacons that can be positioned around the playing field 150 (especially if the field is in an interior/enclosed space). The beacons can be calibrated and then using simple triangulation in the onboard microcontroller and/or a central computer system the positions of all aerial craft and even the field boundary lines and goal(s) 120 can be defined to a much higher degree of accuracy than with a traditional GPS.

An improved iteration may allow or add specialized features such as remotely changing/setting the floating z (height) value and interaction response value(s), or control of visual devices such as LEDs, lights or displays or for reading sensors such as the accelerometer to determine impact, or a specialized sensor 126 used to determine when the object 110 passes a goal line 120 or enters a hole or net etc. and convey those readings to a remote location or change its color or appearance by switching green LEDs to red as an example.

Another improved iteration may allow or add specialized responses of the playing object 110. One example would be that the playing object 110 is programmed to act as a volleyball in such a way that pressure sensors are fitted, or the aforementioned onboard sensors are read by the playing object's onboard processor(s) and upon sensing contact or close proximity, the processor accesses and executes predefined programmed response that causes an amplification of the thrust and trajectory that can be adjusted within the program to achieve desired responses that more closely match the expected characteristics of an actual volleyball's response. Programming of the playing object 110 can allow for user selection of a wide range of such response characteristics that allow, for example, different "modes" such as beginner, intermediate, and advanced in which case the control variables are set/offset/modified in a way that causes more or less speed, thrust, response time etc. In this way, additional "modes" can be created such as, for example, emulating zero gravity, enhanced or decreased gravity/weight, a parabolic ballistic trajectory, or floating under water type responses of the playing object 110 device.

As with the player controlled craft 102, the passive aerial craft (not-player-controlled playing object 110) may be fitted with an external protective cage or shell 106 that aids in preventing the rotors from making impact, ideally made of lightweight aerodynamic materials, and arranged such that it has minimal or no effect on the craft's flight yet provides functional (game appropriate) shape such as, for example, a round soccer ball or a flat and round disc-like hockey puck or perhaps more complex shapes such as a shuttlecock used in badminton, or the shape of a football, an aircraft or a missile.

In addition to their use as a playing object 110, passive aerial craft may additionally be used in a multitude of ways that gain from a fixed position hovering aerial craft, such as, for example, referee observation posts 145, markers, warning devices, advertising platforms, field element supports 122 and assistive devices such as holding tools or supplies.

Passive aerial craft, including the playing object 110 may alternatively be any neutral buoyancy object that floats, any hung, suspended or balanced object that occupies a non-grounded space or any shot, launched, thrown or externally propelled object that occupies or moves through a non-grounded space. Also, as shown in FIG. 1, a non-neutral buoyant object such as a helium balloon may be utilized for supporting field elements, especially if held down by a tether 124.

Manipulation Means and Method

Player attachments 108 such as rackets, hockey sticks, pseudo arms, legs, heads, hands and feet may be individually or collectively attached in desired combinations to the active player craft 102 to be used to manipulate the passive playing object 110 alone and/or while interacting with other active player crafts 102 in a strategic manner together in a team-like fashion or in opposition of another 'player' or 'opposing team'. These attachments 108 can take many useful shapes and be made of numerous materials; ideally these attachments would be fashioned from lightweight, aerodynamic materials such as, in one example, a thin plastic ring with fine fishing line woven into it to form a racket 108. This racket can be fastened to any one of a number of conceivable locations on the active aerial craft 102 to be used as a manipulator and can be controlled by means of controlling the active aerial craft 102. For example: attach to side of a quad copter cage 106, swing racket 108 by controlling the movement of the quad copter 103 in such a way that by adjusting the pitch, roll, yaw and acceleration of the quad copter 103 the controlling player 130 can become skilled in swinging the racket 108 in a multitude of ways in order to manipulate the playing object 110.

The method of use of the active aerial craft 102 with attachment(s) 108 fitted to them is either in standalone singular or with a plurality of said craft 102 acting either together on a "team" or against one or more singular or a plurality of "opposing team(s)" to manipulate one or more playing objects 110 for a predetermined goal or desired outcome.

For example, the use of a 'hockey stick' like device 108 attached to a quad copter active craft 102 and a team of 6 such quad copter crafts 102 against another team of 6 such crafts 102 and the use of a quad copter passive playing object 110 with a exterior cage 106 shaped like a hockey puck. The teams fly the craft 102 in a way that manipulates the 'puck' playing object 110 in the air to control, pass and shoot the 'puck' 110 into a goal net 120. This example describes a form of 3-dimensional aerial hockey.

In another example, a single player craft 102 has a racket-like device 108 attached to manipulate (hit) a tennis ball-like playing object 110 toward a surface such as a wall 120 in such a way that it bounces off and returns in the direction of the player craft 102, and the player craft 102 must be re-positioned by the controlling player 130 to be able to hit the playing object 110 again, in essence playing a form of one person aerial tennis. The bouncing action can be physical or simulated. For example: the object/ball 110 may not need to actually touch the wall, rather the wall proximity can be sensed and the integral processor 105 would then cause the object 110 to respond with an appropriate change in direction, angle and thrust to simulate a bounce.

The use of devices 108 attached to the active aerial craft 102 can be further improved by adding functional control 109 of these attachments 108 such as, for example, causing the racket to be swung by means of a pivoting or rotating active device 109; or for example, the hockey stick may have a spring loaded winding mechanism 109 that can retract the stick in a way that builds and stores kinetic energy that can be released on command to swing at the hockey puck object 110 with the desire of making contact, transferring energy upon impact and thus moving the playing object 110 in order to 'shoot' or 'pass' it more rapidly.

Additional embodiments of manipulation may utilize repellant or attractive devices 107 on any of the aerial craft, including especially the passive playing object 110; such devices 107 being loosely termed in this disclosure as "magnets", for example electromagnets, and/or permanent magnets including magnetized attachments or structural elements of the craft. The playing object 110 and/or the manipulating device 109 and/or the manipulation attachments 108 can comprise one or more magnets 107 that enable attraction and/or repulsion of the playing object 110 and/or other manipulating devices and/or outside objects or areas of play. One example would be a player drone 102 fitted with an arm 108 that has an electro magnet 107, and the playing object 110 being fitted with several magnets and an exterior cage 106 in the shape of a football. A second player drone 102 on the same team may also have an arm that has an electro magnet 107. As the first drone (quarterback) energizes its electro magnet to attract the playing object 110 to its arm the second drone (running back) advances toward the first drone and by switching off the quarterback's electro magnet and switching on the running back's electro magnet at the correct time of close proximity the playing object 110 can effectively be "handed off" to execute a "running play" as is similar to traditional football.

This same example of drone football could also use a passive non-drone playing object 110 such as a lightweight football fitted with magnets. This football-like object is an example of a passive playing object 110 that can be used for aerial game playing even if it does not have buoyancy. If not "caught" or "held", then the passive object would fall groundward as in a real game of football, thereby adding realism and/or extra challenge to the aerial version of the game. Furthermore, the playing object 110 could be adapted to counteract or enhance gravitational effects simply by adjusting the means being used to make the playing object 110 buoyant.

Additional enhancements of the manipulation devices 108 may include player specific attachments such as an active throwing arm for the quarterback, and a net for catching passes that is only used on receivers and defensive backs, whereas all other team members only have blocking-equipped attachments 108.

The above described games can also be played using a passive playing object 110 other than an aerial craft (e.g., any airborne passive object, with neutral or adjustable buoyancy), along with one or more active/player aerial devices 102 that do not have any additional attachments, in which case the exterior shell 106 of the active aerial craft is used to manipulate the passive playing object 110 (e.g., one with a suitable ball like shape) to achieve a predetermined goal such as playing 3-dimensional soccer using drones.

Advanced Method of Manipulation

Control method can be achieved by an individual(s) providing direction through digital/analog direct/remote control means or by artificial or recorded control by means of microcontroller, computer or artificial intelligence, or a combination of both such as advanced control sequences which can be predefined (or recorded) in software and executed on command, i.e. an acrobatic roll shot that requires several combined control variables to be manipulated with rapid and/or sequenced precision that can be executed by the player 130 at will by simply pressing a single button on his controller 104 and the onboard quad copter controller accesses and processes the stored variable sequence to perform the maneuver. Many advanced maneuvers can be stored in this manner and performed by the player with a single predetermined switch/button and or a combination of such in a predetermined sequence or user executed order. A variation on this advanced method would be to interject and utilize real time input from any one or multiple sensors in order to correct/adjust the execution of an advanced control sequence in order to cause a more desirable outcome. For example: if an active quad copter 102 is executing an advanced control sequence and it is bumped by an opposing quad copter 102 which causes it to inaccurately perform the execution of the maneuver, the improved variation would process and correct the execution of the maneuver based on sensor feedback in such a way that is more acceptable based on predefined desired outcomes such as always finishing the maneuver in an upright and level position.

Improved Means of Control

An advanced visual aid may be used to enhance control, examples being the use of an onboard camera 128 on the player craft 102 and a remote screen 104 or video goggles for the player, to receive the camera video in real time and the player views the screen/goggles to control the quad copter 102 or manipulating device 108. Prior art describes use of a video cam, however such methods fall short of allowing the user depth perception which is a significant disadvantage of use and limiting factor for accurately controlling the quad copter when it is manipulating other aerial objects. An improved embodiment of this invention therefor uses two cameras that are spaced apart to emulate human vision which more accurately provides depth perception. Each camera outputs its video to each of two screens fitted in the goggles, effectively providing the right eye with view from the right mounted camera and the left eye view from the left mounted camera, thereby providing 3D (stereoscopic) video that affords the user depth perception.

Further enhancements to this improved configuration would be the use of devices such as motors or actuators to move or rotate the stereoscopic cameras to allow independent control of the quad copter's visual view in relation to its movement or position. This movement can also be accomplished through simulation in which case the cameras are fitted with fish eye, wide angle or specialized mirrors and/or lenses and capture a large area of view but through software manipulation the users view is limited in such a way to only display a portion of the entire image. By control sensors such as a button, joystick or motion sensors mounted on the head or in the goggles the users view can be scrolled or changed. This method can be used to either activate the physical motors and/or actuators to change the cameras position or to change the software's field of display of the larger fixed image as described in the latter non-physical control. Additional enhancements to the video display would be to superimpose data in the form of characters, numbers, or graphics that represent such variables as altitude, horizon, direction, speed, impact or g force, battery life, etc. Further enhancements include superimposing video or graphics onto the users display to simulate the environment, background and/or appearance of the playing object 110 of other members of their team or opposing team or to create simulated playing objects, checkpoints, goals or such effects. The hereindescribed improved means of aerial device control could be used for more than simply game play as described, and therefor may be a desirable improvement for aerial devices (drones) used for a wide variety of functions/purposes.

Although the invention has been illustrated and described in detail in the drawings and foregoing description, the same is to be considered as illustrative and not restrictive in character—it being understood that the embodiments shown and described have been selected as representative examples including presently preferred embodiments plus others indicative of the nature of changes and modifications that come within the spirit of the invention(s) being disclosed and within the scope of invention(s) as claimed in this and any other applications that incorporate relevant portions of the present disclosure for support of those claims. Undoubtedly, other "variations" based on the teachings set forth herein will occur to one having ordinary skill in the art to which the present invention most nearly pertains, and such variations are intended to be within the scope of the present disclosure and of any claims to invention supported by said disclosure.

What is claimed is:

1. An aerial game playing method for aerial simulation of a ground based game wherein opposed human players compete in moving a playing object to a goal location, the method comprising:

adapting a copter-type aerial craft to function as a player drone that is radio controlled by a human player;

adapting an aerial craft to function as an object drone that remains aloft independently of player control;

the player radio controlling the player drone such that it applies a mechanical impulse force to cause movement of the object drone; and providing the player drone and the object drone with cages configured for mechanical impulse force application with directional control.

2. The aerial game playing method of claim 1, further comprising:

defining a three dimensional game playing field with boundaries determined by GPS sensors.

3. The aerial game playing method of claim 2 wherein:

the GPS sensors are adapted to respond to a local positioning system that substitutes local beacons for the GPS satellites.

4. The aerial game playing method of claim 1, further comprising:

providing a stationary aerial field object to function as a goal of caused movement of the object drone.

5. The aerial game playing method of claim 1, wherein:

the cage configurations comprise shapes and surfaces that are game-appropriate for the ground based game being simulated.

6. The aerial game playing method of claim 5 wherein:

the cage configurations are game-appropriate for simulating soccer, comprising a ball-shaped cage around the object drone, and one or more of player drone cage shapes that simulate a person's torso, head, leg and foot.

7. The aerial game playing method of claim 5 wherein:

the game-appropriate cage configurations comprise an appendage that simulates a racket, bat, golf club, scoop, glove, paddle, hockey stick, hand, leg or foot.

8. The aerial game playing method of claim 5 wherein:

the game-appropriate cage configurations comprise an active appendage, moveable relative to the player drone to simulate appendage actions of swinging, kicking, grasping, catching, or throwing.

9. The aerial game playing method of claim 1 wherein:

the object drone is configured for automated movement that incorporates simulation and variation of one or more of gravity, bounce, inertia, attraction, repulsion, elasticity, atmospheric resistance, spin, aerodynamic effects, trajectory, acceleration and velocity.

10. The aerial game playing method of claim 1, further comprising:

configuring the object drone to automatically react to movement of the player drone to make contact more difficult.

11. The aerial game playing method of claim 1, further comprising:

configuring the object drone to have automated or non-player remote controls for enabling adjustments in its behavior.

12. The aerial game playing method of claim 1, further comprising:

a game controlling device utilized by a non-player for actions including one or more of providing auxiliary/external non-player control of the object drone, monitoring or refereeing via an auxiliary aerial device, and maintaining the location of a goal that is held aloft by a hovering passive device.

* * * * *